US008596651B2

(12) United States Patent
Canova

(10) Patent No.: US 8,596,651 B2
(45) Date of Patent: Dec. 3, 2013

(54) HEIGHT ADJUSTABLE WORK SEAT

(76) Inventor: James D. Canova, San Jose, CA (US)

( * ) Notice: Subject to any disclaimer, the term of this patent is extended or adjusted under 35 U.S.C. 154(b) by 23 days.

(21) Appl. No.: 13/210,176

(22) Filed: Aug. 15, 2011

(65) Prior Publication Data

US 2012/0038122 A1 Feb. 16, 2012

Related U.S. Application Data

(60) Provisional application No. 61/373,742, filed on Aug. 13, 2010.

(51) Int. Cl.
*A01D 67/04* (2006.01)

(52) U.S. Cl.
USPC ..... 280/32.5; 280/639; 280/35; 280/32.6; 297/338; 297/344.15

(58) Field of Classification Search
USPC ..... 280/639, 32.5, 32.6, 35; 297/338, 297/344.15
See application file for complete search history.

(56) References Cited

U.S. PATENT DOCUMENTS 4,895,380 A 1/1990 Brooks et al.
5,108,118 A 4/1992 Schaevitz
5,577,744 A 11/1996 Parks
5,611,551 A * 3/1997 Lin ..... 280/32.5
5,707,067 A * 1/1998 Smith ..... 280/32.6
5,720,517 A 2/1998 Prothro, Sr.
5,868,459 A * 2/1999 Welsh, Jr. ..... 297/32
5,897,122 A 4/1999 Borner
6,752,459 B2 6/2004 Deisig
7,055,847 B2 * 6/2006 Miller et al. ..... 280/638
7,097,241 B2 * 8/2006 Tally et al. ..... 297/118
7,237,781 B2 7/2007 Canova

* cited by examiner

*Primary Examiner* — John Walters
*Assistant Examiner* — James Triggs
(74) *Attorney, Agent, or Firm* — Schneck & Schneck; David Schneck

(57) ABSTRACT

A height adjustable work seat is disclosed. The work seat is collapsible and extendable, and has a base, a seat pan and four folding and lockable legs. Four wheels are mounted to the bottom of the base. The folding legs connect the seat pan to the base. Each folding leg pivots at the base, the seat pan and a center pivot. The seat pan is at a maximum height relative to the base with the four folding legs fully extended. The seat pan is at a minimum height relative to the base with the four folding legs fully folded. A releasable locking mechanism secures each of the folding legs in a fully extended condition. One or more crossbars may connect opposing sleeve locks, aiding in locking, unlocking, folding or extending the pair of legs between which each crossbar extends. The seat pan may have a seatback.

9 Claims, 4 Drawing Sheets

HEIGHT ADJUSTABLE WORK SEAT

CROSS REFERENCE TO RELATED APPLICATION

This application claims priority from U.S. provisional application Ser. No. 61/373,742, filed Aug. 13, 2010.

TECHNICAL FIELD

The present invention relates generally to mobile chairs and seats and more specifically to height adjustable or collapsible mobile chairs with plural operative configurations.

BACKGROUND

U.S. Pat. No. 7,237,781 (hereby incorporated by reference for all purposes herein) discloses a mechanics chair with at least one side tray. A frame onto which a seat is mounted has four wheels at corner locations of the frame. The bottom of the seat is not more than 12 inches from a surface on which the four wheels rest.

A variety of mechanics creepers are known and commercially available. Generally, a creeper has four wheels mounted at corner locations of a frame. In use, a mechanic lies down on the creeper and maneuvers the creeper around or underneath an automobile while working on the automobile. The creeper has a low profile in order to fit underneath the automobile, and may fit underneath the automobile with the mechanic atop the creeper when the automobile is on jack stands or otherwise lifted. A mechanic may also sit on the creeper.

Height adjustable office chairs using a gas lift for height adjustment are known and commercially available. Office chairs, with or without gas lift, are available with wheels such as casters or other types, for moving the office chair with or without a person seated on the chair. Gas lift mechanisms generally employ an inner and outer telescoping tube with a sealed gas chamber within the tubes, and are limited in a minimum height of the chair by the height of the greater of the outer tube and the inner tube. Generally, in a gas lift mechanism with two telescoping tubes, the height adjustment range is less than or equal to one half of the maximum extension of the two tubes.

It is a goal of the present invention to provide a movable or mobile chair for automotive or other use that improves upon the height adjustment range of a gas lift office chair.

SUMMARY

The above goals are met in a height adjustable work seat as described herein. The height adjustable work seat is mobile and collapsible, and has two operative configurations, namely a minimum height configuration and a maximum height configuration. The seat is dimensionally and operably suitable for automotive work.

In a first embodiment, a height adjustable work seat has a base and a seat pan. Four wheels are mounted to the bottom of the base. Four folding legs connect the seat pan to the base.

Each folding leg pivots at the base. Each folding leg pivots at the seat pan. Each folding leg pivots at a respective center pivot.

A releasable locking mechanism secures each of the folding legs in a fully extended condition. The seat pan is at a maximum height relative to the base with the four folding legs fully extended. The seat pan is at a minimum height relative to the base with the four folding legs fully folded.

In a second embodiment, an extendable seat has a seat pan, four wheels, a base and four legs. The base has the four wheels pivotably mounted to the bottom of the base. The four wheels are positioned outboard relative to the seat pan.

The legs are collapsed, extendable and lockable. Each leg is connected at a first end to a respective base pivot. Each leg is connected at a second end to a respective seat pan pivot. Each leg is folded at a respective center pivot. The extendable seat has a minimum height configuration with the legs collapsed. The extendable seat has a maximum height configuration with the legs extended and locked.

In a third embodiment, a collapsible mobile chair has a seat, a base, four wheels and four collapsible legs. The seat has a seat pan and a seatback. The base has first and second side sections that extend past respective sides of the seat pan.

Four caster wheels are mounted to the base. The first and second caster wheels are mounted to the first side section of the base. The third and fourth caster wheels are mounted to the second side section of the base.

The legs are extended and foldable. Each leg is connected foldably at a first end to the base. Each leg is connected foldably at a second end to the seat pan. Each leg is foldable at a respective center knee joint. When folded, the respective first and second ends of the leg meet. The center knee joints of the front legs fold towards each other. The center knee joints of the rear legs fold towards each other. Folding the front legs and the rear legs collapses the legs and the chair.

DETAILED DESCRIPTION

Figure 1:
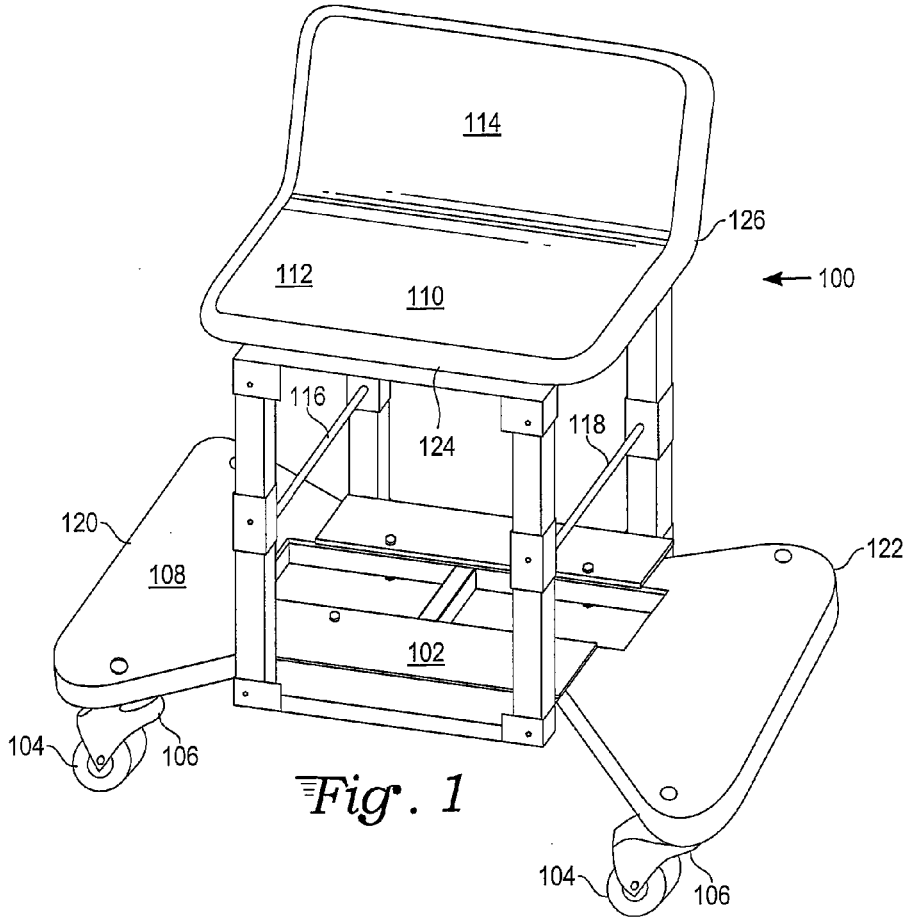
FIG. 1 is a perspective view of a height adjustable work seat in accordance with the present invention, shown at full height.

With reference to FIG. 1, a height adjustable work seat 100 suitable for use by an automotive mechanic or other professional is shown. The height adjustable work seat has two major positions of operation, namely a full or maximum height and a very low or minimum height. At intermediate positions of operation, the height adjustable work seat is partially collapsed or partially extended.

When working on an automobile, a mechanic may be standing, seated at a nominally conventional seating height, kneeling or sitting upon a floor, sitting or lying upon an automotive creeper or otherwise positioned so as to use tools and to access various regions at various heights of the automobile. Traditionally, the mechanic uses the creeper only for accessing very low points of the automobile, and the creeper is either in the way or is moved out of the way while the mechanic works on intermediate or higher points of the automobile, bending or kneeling accordingly. The height adjustable work seat 100 allows the mechanic to select a very low or full height position of the seat, as needed for working on various regions of the automobile.

As shown in FIG. 1, the base 102 of the height adjustable work seat 100 has four wheels 104, which may have casters 106, mounted at or near corners of the base 102. In one example, the wheels 104 swivel with respect to the base 102.

Various sizes of bases can, be devised. In the example shown in FIG. 1, the base 102 has first and second side sections 120, 122 that extend past respective sides of the seat pan. The first and second side sections 120, 122 extend further forward than the front edge 124 of the seat pan 112, and extend further backward than the rear edge 126 of the seat pan 112. The four wheels 104 are mounted accordingly, with the wheels being positioned outboard of the seat pan 112 for stability. In other words, the wheels 104 are positioned further fore and aft than the front to back extent of the seat pan 112, and the wheels 104 are positioned further to the sides than the lateral extent of the seat pan 112.

With the wheels mounted further apart than the dimensions of the seat pan 112, as when the base 102 including the side sections 120, 122 is wider and deeper than the seat pan 112 and the wheels 104 are mounted near the outermost corners of the base 102, the height adjustable work seat 100 exhibits stability both laterally and fore and aft. In one example, an upper surface 108 of the base may fit underneath the frame of the automobile, as when low-profile wheels such as found on a creeper are fitted to the frame.

At the fully extended or maximum height position of the height adjustable work seat, the mechanic is comfortably seated at a nominal seating height and may roll the seat about the workspace until a very low height of the work seat is desired. In one embodiment, the upper surface 110 of the seat pan 112, not including the seatback 114, is approximately seventeen inches above a floor or other surface upon which the wheels 104 roll, when the height adjustable work seat 100 is at the maximum height position. Further embodiments may have a seat pan 112 height of fourteen inches or other selected dimension above the floor. A mechanic, seated upon the height adjustable work seat in the maximum height position, can work upon the middle and upper regions of the front, sides and back of an automobile. At such time as a very low height of the work seat is desired, the mechanic collapses the work seat to the minimum height.

Figure 2:
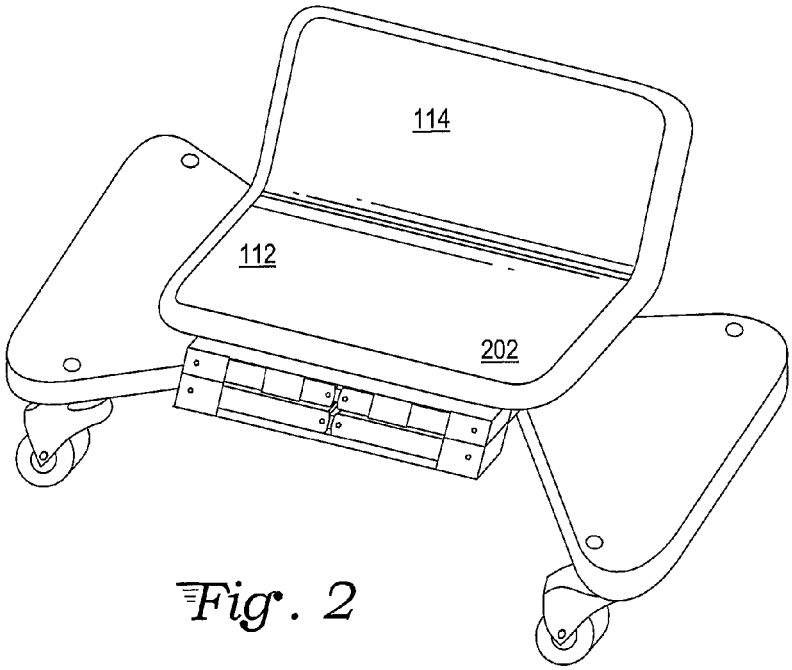
FIG. 2 is a perspective view of the height adjustable work seat of FIG. 1, shown collapsed at a minimum height.

With reference to FIG. 2, when the legs of the height adjustable work seat are folded and the work seat is collapsed to the minimum height, the seat pan is very low to the ground. In one example, the seat pan is approximately as low to the ground in the minimum height position as a bottom portion of a seat of the mechanics chair with side tray disclosed in U.S. Pat. No. 7,237,781.

At the fully collapsed or minimum height position, the work seat is approximately as low to the ground as if a seat pan and seatback had been mounted to a mechanics creeper. The mechanic maneuvers the work seat in the minimum height position about the workspace to access lower regions of the automobile. In one embodiment, the upper surface of the seat pan, not including the seatback, is no more than twelve inches above a floor or other surface upon which the wheels roll, when the height adjustable work seat is at the minimum height position. In a further embodiment, a lowermost portion 202 of the top surface 110 of the seat pan 112, not including the seat back 114, is 6 inches above the floor when the height adjustable work seat is at the minimum height position. A mechanic, seated upon the height adjustable work seat in the minimum height position, can work upon the lowermost regions of the front, sides and back of an automobile.

Figure 3:
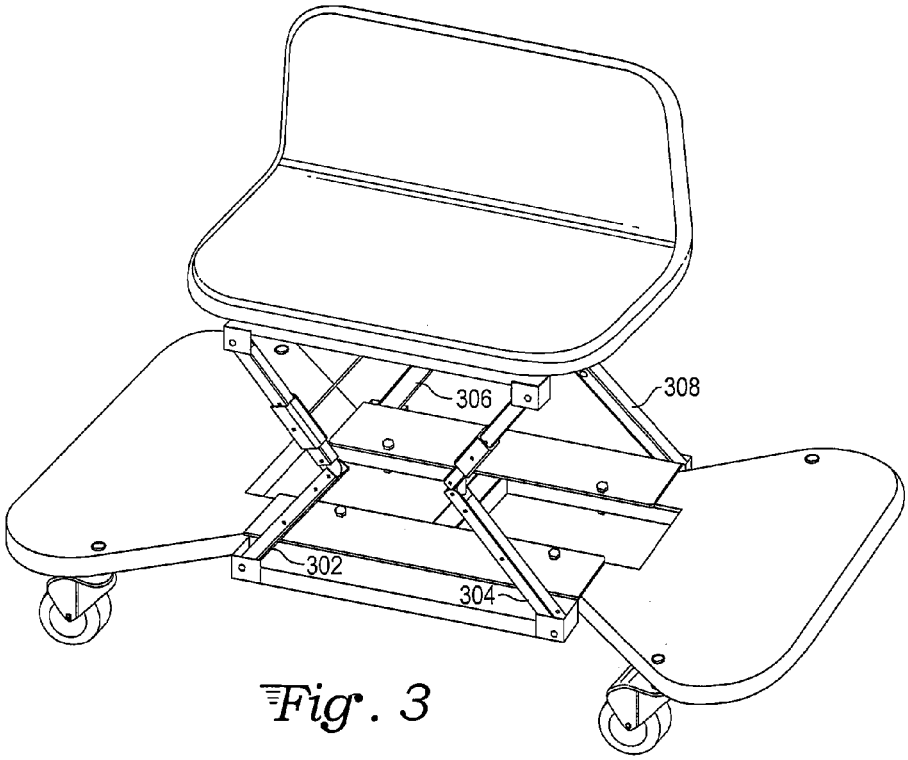
FIG. 3 is a front view of the height adjustable work seat of FIG. 1, shown partially collapsed or partially extended.

With reference to FIG. 3, the height adjustable work seat is shown with all four legs 302, 304, 306 and 308 partially collapsed or partially extended. Seen from the front of the seat, the two front legs 302 and 304 collapse or fold towards each other, as do the two back legs 306 and 308. The two front legs 302 and 304 fold along a front folding plane perpendicular to the floor, and the two back legs fold along a back folding plane perpendicular to the floor. Seen from either side of the seat the legs of that side collapse or fold away from the viewer, towards the opposed side legs. In a variation, the legs of one side collapse or fold towards each other in a side folding plane, the legs of the opposing side likewise collapsing or folding towards each other in a further side folding plane. Other leg-folding configurations may be devised by a person skilled in the art.

Further variations of the height adjustable work seat include various mechanisms for raising and lowering the seat. A scissors lift may be manually operated and have stops or ratchets at multiple positions. Further, a scissors lift may be operated by a screw, using a handle or a motor drive. Removable legs may be inserted into sockets in the base and the seat pan assembled onto the removable legs to raise the seat, with the legs removed for the lowered seat position. A seat may hang on upright rods or columns extending upward from a base, the seat being secured to the rods or columns at a variable height. A seat may spin on a large diameter screw that is threaded into the base, for height adjustment. Sliding ramps may move inward or outward to adjust a height of the seat relative to the base. One, too, three or four legs may be included.

Figure 4:
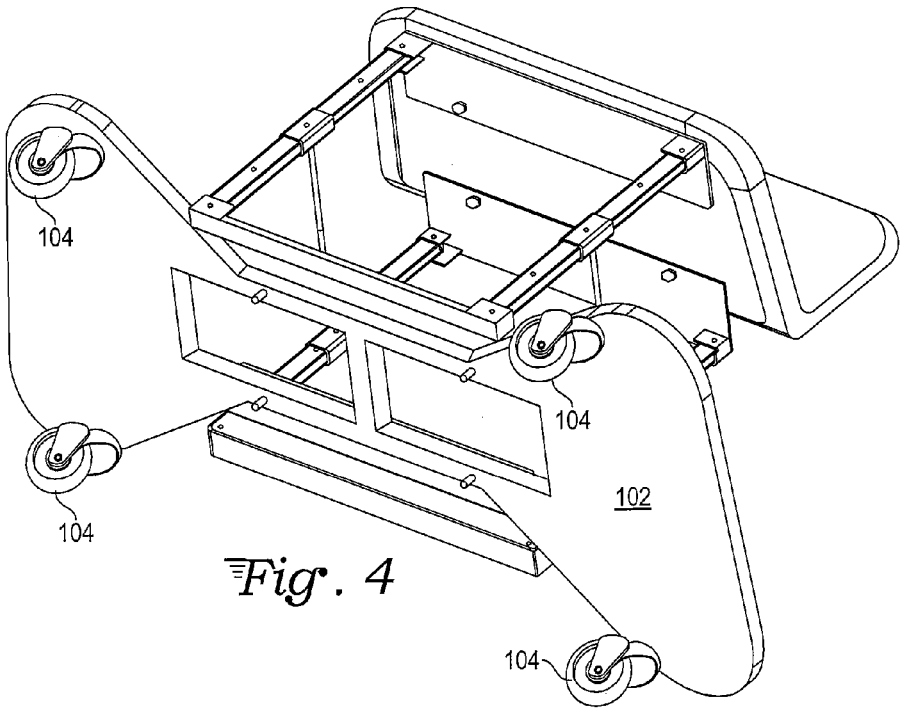
FIG. 4 is a perspective view of the underside of the height adjustable work seat of FIG. 1.

With reference to FIG. 4, a placement of pivoting wheels 104 near the four outboard corners of the base 102 of the height adjustable work seat 100 is shown. Each wheel rolls about a horizontal axis and each wheel assembly pivots about a vertical axis, in a manner known in the art. Other arrangements of wheels, wheel types and mountings or placements of mountings may be devised. Placing the wheels farther away from a vertical centerline or a center of gravity of the height adjustable work seat provides additional stability.

Figure 5:
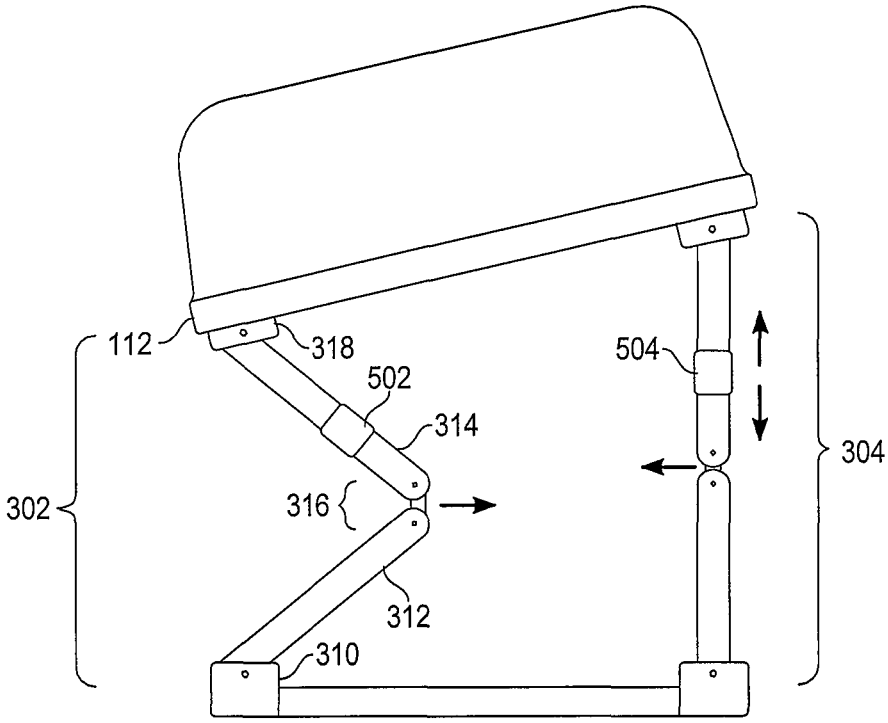
FIG. 5 is an elevated front view of two legs of the height adjustable work seat of FIG. 1, with one leg being partially collapsed or folded. The rear legs are obscured in the view.

With reference to FIG. 5, each leg 302, 304 has a center pivot 316 or knee joint allowing the leg 302 to fold or pivot. Each leg has a further pivot 318 at the top of the leg where the leg is pivotably connected to the seat pan or to a frame supporting the seat pan. Each leg has a still further pivot 310 at the bottom of the leg where the leg is pivotably connected to the base.

Thus, each leg has three pivots, one each at top, center and bottom of the leg. Equivalently, for each leg, the leg 302 has a lower leg 312 and an upper leg 314. The bottom pivot 310 foldably connects the lower leg 312 to the base 102. The center pivot 316 foldably connects the lower leg 312 to the upper leg 314 such that the lower leg 312 and the upper leg 314 can meet when folded together. The top pivot 318 foldably connects the upper leg 314 to the seat pan 112 or seat pan frame.

In FIG. 5, the height adjustable work seat is shown with the two legs of one side partially collapsed or partially extended, and the two legs of the opposed side fully extended, although a view of the rear legs is obscured by the front legs in the elevated front view. In the example shown, the respective center pivots 316 of the front legs 302, 304 fold towards each other, and the respective center pivots of the rear legs fold towards each other.

Figure 6:
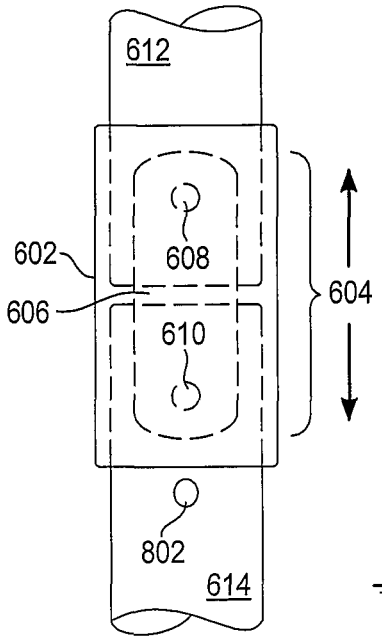
FIG. 6 is a close-up elevated view of a knee joint of a folding leg of the height adjustable work seat of FIG. 1, with a sleeve lock.
Figure 8:
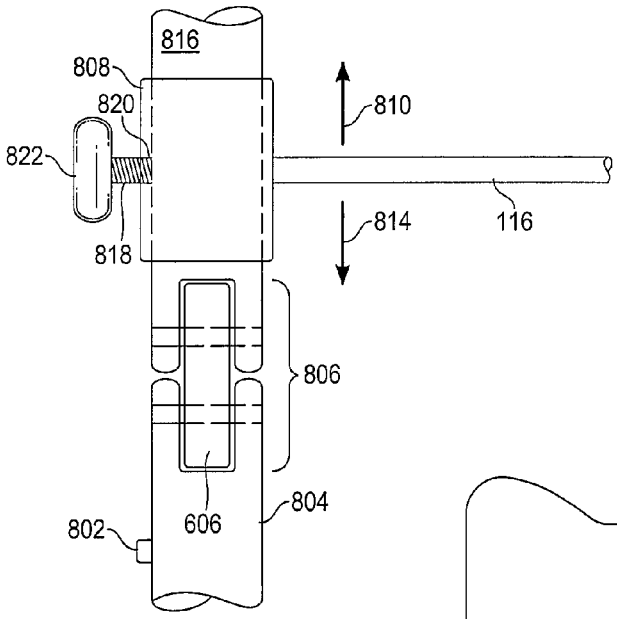
FIG. 8 is a close-up elevated view of the knee joint and sleeve lock of FIG. 6, with the sleeve lock having an attached crossbar.

With reference to FIGS. 5, 6 and 8, a sleeve lock 502, 504 telescopically slides up or down an upper portion of each leg 302, 304, and locks the leg in a fully extended position or unlocks the leg. The sleeve lock may be a section of tubing of slightly larger inside dimensions than the outside dimensions of the upper leg section or the center pivot section, allowing for a sliding fit. The sleeve lock 502, 504 slides over the center pivot 316 of the leg to lock the leg 302, 304, and slides off of the center pivot 316 of the leg to unlock the leg 302, 304. Each sleeve lock 502, 504 is a slidable locking sleeve on a respective leg, engaging and preventing the respective knee joint or other center pivot 316 from folding. Each sleeve lock 502, 504 is disengageable to enable folding the respective center pivot 316. Other mechanisms may be devised to lock a folding leg in a fully extended position and unlock the leg for folding.

Sleeve locks of the two legs belonging to one side of the seat may be connected by a crossbar 116, as shown in FIGS. 1, 3, 4 and 8. In one example, there are two crossbars 116 and 118, a first crossbar 116 rigidly connecting sleeve locks of a first side of the chair and a second crossbar 118 rigidly connecting sleeve locks of a second side of the chair. In a further example, where the legs of the first side of the chair fold towards each other, a crossbar connects the sleeve locks of the front legs and a second crossbar connects the sleeve locks of the back legs. Each crossbar is oriented perpendicular to the respective folding planes of the legs between which the crossbar spans. Thus, a crossbar does not interfere with the folding of the legs that the sliding locks of the crossbar engage.

In order to raise the height adjustable work seat from the minimum height as shown in FIG. 2 to the full height as shown in FIG. 1, the mechanic releases any holding device that retains the work seat or chair in the minimum height position, then grasps and lifts the upper portion of the work seat e.g. by the seatback or seat pan. The upper portion of the work seat may be lifted and kept parallel with the floor with all four legs extending or unfolding simultaneously as shown in FIG. 3, or lifted by one side followed by the other side as shown in FIG. 5. As the upper portion of the work seat is lifted, the folding legs of one or both sides straighten out, and the center pivots or knee joints move outward from the folded, collapsed or stowed position to the extended or upright position. The mechanic may pull on the crossbars to assist the legs in opening. Once the legs are fully extended, the mechanic pushes downward on the locking sleeves until each locking sleeve slides over the corresponding center pivot or knee joint, locking the center pivot or knee joint rigidly in place. As shown in FIG. 8, suitable protrusions or other stops 802 extending from a portion of each lower leg 804 serve to constrain each locking sleeve 808, preventing the locking sleeve from sliding further downward on the leg 804 and unlocking the center pivot 806 or knee joint. The mechanic may push on each crossbar to assist the corresponding locking sleeves in sliding over the knee joints of the respective legs. Other mechanisms may be devised for retaining the locking sleeve in a locked position at the center pivot, such as a spring-loaded ball on the locking sleeve engaging a detent on a portion of a leg or vice versa.

In order to lower the height adjustable work seat from the full or maximum height as shown in FIG. 1 to the minimum height as shown in FIG. 2, the raising procedure is reversed. The mechanic slides each locking sleeve upward, disengaging the locking sleeve from the corresponding center pivot or knee joint and allowing the respective leg to pivot at the center. The mechanic may pull on the crossbars to assist the corresponding locking sleeves in sliding off of the knee joints of the respective legs. Next, the legs are collapsed. Each leg may be folded in half, one at a time, or pairs of legs on a side or pairs of legs at a front or a back may be collapsed together, or all four legs may be folded at the same time. The mechanic may press on one or both crossbars to assist the corresponding legs in folding. Once the legs are fully collapsed, the mechanic may use the work seat in the minimum height position. In a variation, once the legs are fully collapsed, a holding device such as a latch, a pin or a hook is engaged that retains the work seat or chair in the minimum height position.

With reference to FIG. 6, an example of a knee joint 604 is shown, with the locking sleeve 602 in-place and rigidly securing the knee joint 604 in an open or fully extended position. In the example, the knee joint 604 has a center link 606 or plate with two pivots 608 and 610, a first pivot 608 pivotally connecting the center link 606 to the upper leg 612, and a second pivot 610 pivotally connecting the center link 606 to the lower leg 614. The locking sleeve 602 may completely surround the knee joint 604 when the knee joint is in the fully extended position.

Figure 7:
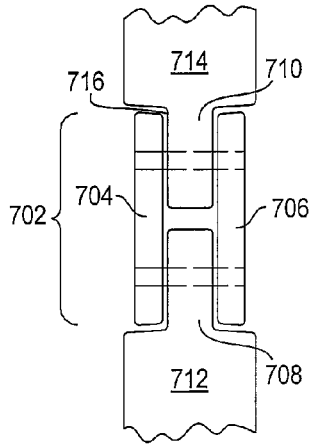
FIG. 7 is a close-up elevated view of a variation of the knee joint of FIGS. 6 and 7.

With reference to FIG. 7, variations of the knee joint may be devised. The knee joint may have a center link or one or more side plates or links. In one variation, the knee joint 702 has two side plates or links 704 and 706 flanking respective linking projections 708 and 710 from the lower leg 712 and the upper leg 714. In order for the side plate or plates to be recessed and allow sliding clearance for a close-fitting locking sleeve, corresponding ends of the folding legs that join at a knee joint may be thinned or have recesses 716 fitting the plates.

With reference to FIG. 8, the extended knee joint is shown rotated by one quarter of a turn about a vertical axis from the view as shown in FIG. 6. The locking sleeve 808 slides upward 810 or downward 814 along the upper leg 816 to unlock or lock the center pivot 806 or knee joint. One or more of the locking sleeves may be secured in a locked or an unlocked position. A securing device, such as a pin through a hole in the locking sleeve and engaging a hole in an upper leg or in a knee joint plate, fixes the locking sleeve in a selected location. In a variation, the securing device may be a bolt 818 through a threaded hole 820 in the locking sleeve 808, the bolt being tightened to a friction fit on the upper leg, on the knee joint plate or elsewhere. The pin or bolt may have a knob or other easily grasped head 822. In a still further variation the securing device may be a bolt through a threaded hole in the locking sleeve and engaging a hole in an upper leg or in a knee joint plate or elsewhere. In one example all four locking sleeves have bolts. Other mechanisms for holding each locking sleeve in place with the corresponding leg in a locked or an unlocked position may be devised.

Figure 9:
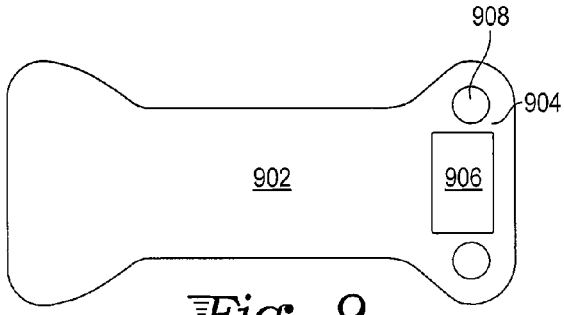
FIG. 9 is an elevated view of a base of the height adjustable work seat of FIG. 1, with a side tray or tool tray.

With reference to FIG. 9, the base 902 of the height adjustable work seat may have one or more side trays 904, tool trays 906 or beverage holders 908 to one or both sides of the mountings for the legs of the seat. A tray or trays may be fixed or removable. A tray may be mounted to or integral with the base or extensions thereof. Tools or other working materials, or a beverage for the mechanic, may be placed or stored in the side tray without interfering with the folding mechanism for the legs of the seat. Further, with tools so positioned, a mechanic may reach down to grasp a tool rather than having to fumble underneath the seat as when tools are stored in an under-seat tray.

Figure 10:
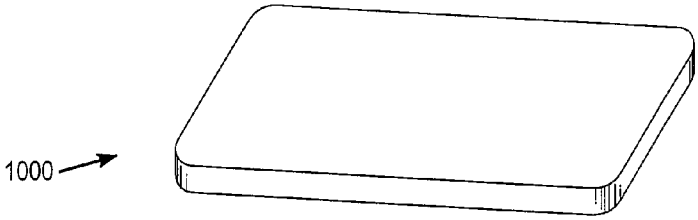
FIG. 10 is a perspective view of a seat pan or a seat suitable for the height adjustable work seat of FIG. 1.
Figure 11:
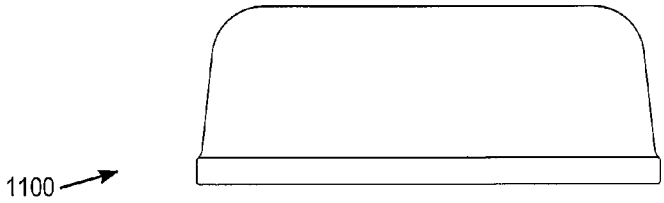
FIG. 11 is an elevated view of a seatback suitable for the height adjustable work seat of FIG. 1.

With reference to FIGS. 10 and 11, various seating devices may be attached to or otherwise incorporated into the height adjustable work seat. A seat pan 1000 and seatback 1100 provide a comfortable sitting arrangement for a mechanic. The seatback 1100 may be a half-height seatback. In a further example, a seat pan 1000 without a seatback may be fitted to the height adjustable work seat, which then functions as a height adjustable stool. A seat may be formed of a seat pan 1000 as shown in FIG. 10 or a seat pan 112 and integrated seatback 114, which may be a half-height seatback, as shown in FIGS. 1-4. In a still further example, a tray or a platform is fitted in place of the seat pan and seatback, and the height adjustable work seat functions as a height adjustable work tray, a height adjustable platform or a height adjustable seat and tray combination.

What is claimed is:

1. A collapsible mobile chair comprising:

a seat having a seat pan and a seatback;

a base having first and second side sections that extend past respective sides of the seat pan;

four caster wheels, with first and second caster wheels mounted to the first side section of the base and third and fourth caster wheels mounted to the second side section of the base; and four extended, foldable legs, with each leg:

connected foldably at a first end to a front and back edge of said base;

connected foldably at a second end to the seat pan; and foldable at a respective center knee joint such that the first and second ends meet, wherein the center knee joints of front legs fold towards each other and the center knee joints of rear legs fold towards each other thereby collapsing the chair, wherein the first and second side sections extend further forward than a front edge of the seat pan and a tapered base section and extend further backward than a rear edge of the seat pan and the four caster wheels are mounted accordingly.

2. The chair of claim 1 further comprising a tool tray mounted to or integral with at least one of the first and second side sections of the base.

3. The chair of claim 1 wherein each knee joint has a center link with two pivots.

4. The chair of claim 1 wherein each knee joint has two side plates and two pivots.

5. The chair of claim 1 further comprising:

a slidable locking sleeve on each leg, engaging and preventing the respective knee joint from folding and disengageable to enable folding the respective knee joint; and first and second side crossbars, the first side crossbar rigidly connecting first respective front and rear slidable locking sleeves and the second side crossbar rigidly connecting second respective front and rear slidable locking sleeves.

6. The chair of claim 5 further comprising:

a securing device that fixes each of the respective slidable locking sleeves in a selected location, with the corresponding leg extended.

7. The chair of claim 5 further comprising:

a securing device that fixes each of the respective slidable locking sleeves in a selected location, with the corresponding leg folded.

8. The chair of claim 1 further comprising a holding device that retains the chair at a minimum height with the legs folded.

9. The chair of claim 1 wherein the chair is operable as a mobile chair in a first configuration at a maximum height with the legs extended and in a second configuration at a minimum height with the legs folded.

* * * * *